United States Patent [19]

Camisa et al.

[11] 3,996,536

[45] Dec. 7, 1976

[54] METAL-INSULATOR-SEMICONDUCTOR DEVICE PHASE SHIFTER

[75] Inventors: Raymond Louis Camisa, Hightstown; Benjamin Franklin Hitch, Somerville; Shui Yuan, Princeton, all of N.J.

[73] Assignee: RCA Corporation, New York, N.Y.

[22] Filed: June 20, 1975

[21] Appl. No.: 588,763

[52] U.S. Cl. ..... 333/31 R; 307/320; 333/7 D; 333/24 C; 333/80 T; 333/97 S

[51] Int. Cl.[2] ..... H01P 1/15; H01P 1/18

[58] Field of Search ..... 333/31 R, 7 D, 24 C, 333/80 T, 97 S; 307/320; 357/14

[56] References Cited

UNITED STATES PATENTS

| | | | |
|---|---|---|---|
| 3,750,055 | 7/1973 | Funck | 333/31 R |
| 3,774,123 | 11/1973 | Hume | 333/7 D |
| 3,778,645 | 12/1973 | Mattauch et al. | 307/320 X |
| 3,890,631 | 6/1975 | Tiemann | 357/14 |
| 3,909,751 | 9/1975 | Tang et al. | 333/7 D |
| 3,911,382 | 10/1975 | Harth et al. | 333/31 R X |

*Primary Examiner*—Eugene La Roche
*Attorney, Agent, or Firm*—Edward J. Norton; Robert L. Troike

[57] ABSTRACT

A microwave signal phase shifter using a metal-insulator-semiconductor (MIS) device is provided. In one preferred embodiment, one end of the device is coupled to a port of a circulator and the opposite end is coupled to ground. When the diode is switched from a first reverse bias state to a second forward bias state, the network switches from a first reactance to a second reactance and the reflection coefficient phase angle shifts.

7 Claims, 11 Drawing Figures

METAL-INSULATOR-SEMICONDUCTOR DEVICE PHASE SHIFTER

The invention herein described was made in the course of or under the contract or subcontract thereunder with the Department of the Air Force.

BACKGROUND OF THE INVENTION

This invention relates to phase shifters and more particularly to a phase shifter using a metal-insulator-semiconductor (MIS) type device. Diode phase shifters using PIN diodes as the switching element have exhibited excellent performance at microwave frequencies. The main drawback is the high current (several milliamps) required by PIN diodes in their forward bias state. A phased array antenna system comprising many such phase shifters requires several amperes of bias current, resulting in complex and costly drivers and bias distribution circuitry. Reverse bias junction varactors have been used in reflection type phase shifters, overcoming the current requirement problem. The voltage variable capacitance becomes a voltage variable reflection coefficient angle when terminating in a transmission line. In a reflection type phase shifter, this is translated into a voltage variable transmission coefficient angle. It can be seen that as the bias changes, the phase shift changes and, because the device is reverse biased at all times, the steady state current required is very small, on the order of microamperes or nanoamperes.

The reverse bias junction varactor approach suffers limitations, however, due to the shape of the C-V curve of a standard varactor. At one relatively high reverse bias level, the capacitance is approximately constant with voltage. However, at a lower reverse bias level, the capacitance changes relatively rapidly with voltage. If the RF voltage swing is large, a nonlinear waveform is generated with high harmonics. Moreover, as the nonlinear portion of the curve is approached, the average capacitance changes causing the phase to change. The phase shift is therefore not constant with power level. Another problem is that power supply drift or ripple will cause phase error. This is sometimes turned into an advantage since it enables phase trimming through supply level adjustment, but this is not usually a desirable way to trim as the disadvantages frequently outweigh the advantages.

SUMMARY OF THE INVENTION

Briefly, a microwave phase shifter is provided using a metal-insulator-semiconductor device. Microwave signals are applied to one terminal end of the device. The second terminal of the device is coupled to ground or reflection potential. Microwave signals are coupled from the one terminal end of the device. The metal-insulator-semiconductor device is characterized by a substantially fixed value of capacitance when biased over a first relatively broad range of dc voltage, and by exhibiting a second substantially different value of capacitance when biased over a second relatively broad range of dc voltages. When the bias to the device is switched from any value in the first range of dc voltage to any value in the second range of dc voltage, the capacitance changes substantially a given amount and the reflection coefficient phase angle shifts substantially a given amount.

BRIEF DESCRIPTION OF THE DRAWING

A detailed description follows in conjunction with the following drawings wherein.

DESCRIPTION OF PREFERRED EMBODIMENTS

Figure 1:
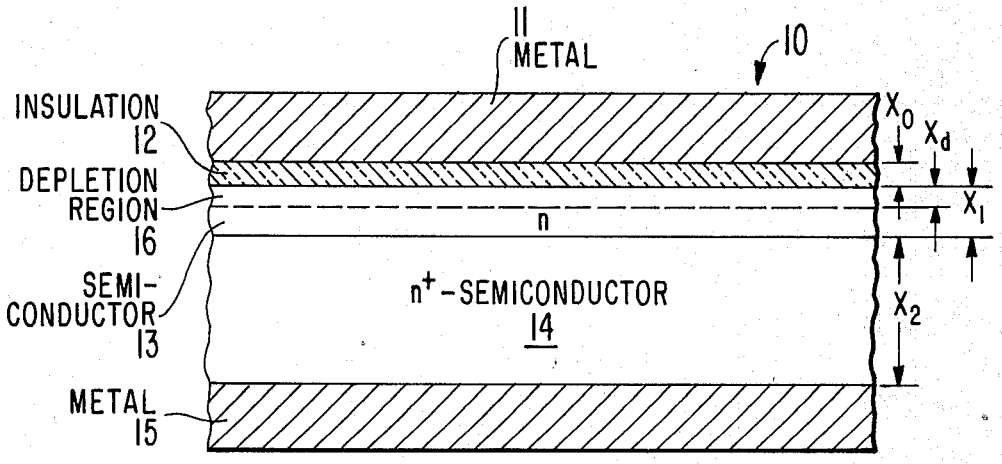
FIG. 1 is a cross section of a metal-insulator-semiconductor device structure.

FIG. 1 is a cross section of a typical metal-insulator-semiconductor (MIS) device structure 10 consisting of metal layer 11, insulator layer 12, n type epitaxial semiconductor layer 13, n+ semiconductor layer 14, and metal layer 15 (M-I-n-$n^+$-M). This one structure may be operated using surface depletion and carrier injection. Also, with each mechanism, the device may be operated in a nonlinear capacitive or nonlinear resistive mode. The surface depletion mechanism is best understood theoretically and is discussed.

In the surface depletion mechanism, the surface of the semiconductor at the semiconductor-insulator interface is depleted of carriers forming a series connection of fixed insulator capacitance and a variable depletion capacitance. In series with the two capacitors is a series resistance which corresponds to the resistance from the edge of the depletion region to the substrate. As the reverse bias voltage is increased between the two metal contacts at opposite ends of the device the depletion layer 16 penetrates deeper into the epitaxial layer 13 until a maximum depletion depth ($X_{dm}$) is reached. This maximum depth is caused by the formation of an inversion layer (holes → n, electrons → p) at the semiconductor-insulator interface. The maximum depletion depth is dependent upon the resistivity of the epitaxial layer and the semiconductor used. If the inversion layer is prevented from forming there is no limit on depletion depth.

Figure 2:
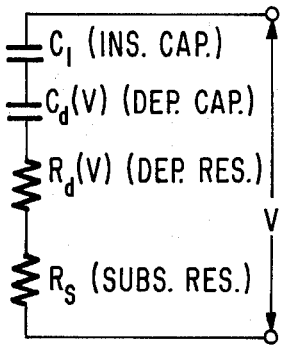
FIG. 2 is an equivalent circuit of a metal-insulator-semiconductor device operated as a surface depletion device.

FIG. 2 is an approximate equivalent circuit of an MIS structure operated as a surface depletion device. For this discussion, the insulator is assumed perfect and is characterized by a relative dielectric constant $K_o$. Therefore, the insulator capacitance $C_I$ is:

$$C_I = K_o \epsilon_o \frac{A}{X_o} \qquad (1)$$

where $\epsilon_o$ = permitivity of free space
$A$ = cross sectional area (micron)$^2$
$X_o$ = insulator thickness (micron).

Note: ($\epsilon_o = 8.86 \times 10^{-6}$ picofarads/micron) The epitaxial semiconductor layer 13 ($X_1$) may be characterized by the resistivity of the material, which is a function of doping density, and the relative dielectric constant of the semiconductor ($K_S$). Therefore, the depletion capacitance and resistance may be described by:

$$C_d(v) = \frac{K_s \epsilon_o A}{X_d(v)} \quad (2)$$

$$R_d(v) = \rho_1 \frac{X_1 - X_d(v)}{A} \quad (3)$$

where $X_d$ is the thickness of the depletion region. Note: that $\rho_1$ (ohm-micron) = $\rho_1$ (ohm-cm) X $10^4$. The substrate resistance is dependent upon the resistivity of the substrate ($\rho_2$) and any geometric spreading of the fields.

$$R_s = F\rho_2 \frac{X_2}{A} \quad (4)$$

where $X_2$ is the thickness of the n+ layer and F is a geometric factor between zero and one.

$$0 < F \leq 1$$

In the surface depletion mode an important parameter is the maximum depletion depth $X_{dm}$. As the semiconductor is continuously reverse biased, a voltage is reached whereby the semiconductor can no longer be depleted and an inversion layer forms at the semiconductor-insulator interface. This maximum depletion depth has been shown by others to be approximately:

$$X_{dm} = \left(\frac{4K_s \epsilon_o \phi_F}{qN_D}\right)^{1/2} \quad (5)$$

$$|\phi| = \frac{kT}{q} \ln \frac{N_D}{n_i} \quad (6)$$

where $k$ = Boltzmann's constant $T$ = temperature in °k $q$ = magnitude of electronic charge $N_D$ = donor density $n_i$ = intrinsic carrier concentration.

For a given semiconductor material, the relationship between maximum depletion depth and the resistivity of the epitaxial layer is given by the empirical relationship:

$$X_{dm} = \alpha \rho^{\beta}$$

where $\alpha$, $\beta$ depend upon the material and the temperature. At room temperature:

$$\text{Silicon} \begin{cases} \alpha = 0.44 \text{ microns} \\ \beta = 0.465 \end{cases}$$

-continued $$\text{GaAs} \begin{cases} \alpha = 1.3 \text{ microns} \\ \beta = 0.477 \end{cases}$$

The structure shown in FIG. 1 may be operated in a variable capacitance mode by using a relatively low resistivity ($\rho < 1$ (ohm-cm) thin epitaxial layer and a thin oxide. The capacitance versus voltage characteristic is sketched in FIG. 3. As is shown by this figure, the high frequency total capacitance versus voltage has a unique "two state" nature where, in the two separate regions, capacitance does not vary with applied voltage. In the first region, the device is reversed biased and in the second region the device is forward biased. The ratio of the high state to low state capacitance ($C_H/C_L$) is given by the expression:

$$\frac{C_H}{C_L} = 1 + \frac{K_o}{K_s} \times \frac{X_{dm}}{X_o} \quad (7)$$

Figure 3:
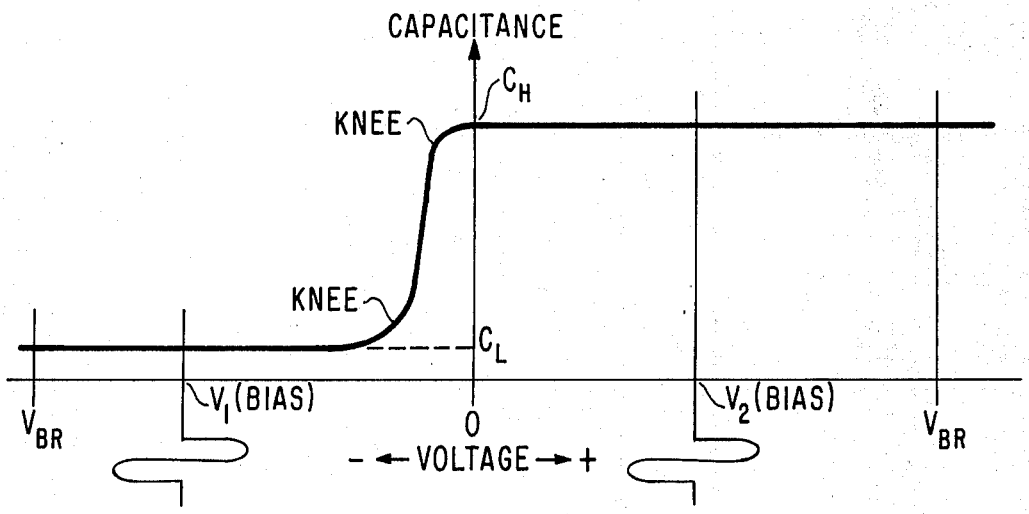
FIG. 3 is a plot of the capacitance vs. voltage characteristic of a metal-insulator-semiconductor device.

The C-V curve in FIG. 3 is approximately flat in both bias regions which results in great reduction in the sensitivity to power level and bias variations. The fact that the device is forward biased at voltage $V_2$ is not a disadvantage since the insulation layer prevents any D.C. current from flowing.

For a further discussion of an MIS device, see Chapter 9 of a book published by Wiley-Interscience entitled "Physics of Semiconductor Devices." The author is S. M. Sze. The capacitance ratio may be increased by increasing $X_{dm}$ or insulator dielectric constant $K_o$, or by decreasing insulator thickness $X_o$. For a given material, the depletion depth ($X_{dm}$) is increased by increasing resistivity. However, this also increases the substrate resistance ($R_s$) which is undesirable so a compromise is necessary. Note that for any $\rho$, Gallium Arsenide (GaAs) material offers a larger depletion depth ($X_{dm}$) than silicon. Increasing the insulator dielectric constant ($K_o$) is accomplished by using an insulator of higher dielectric constant. Such an insulator may have lower dielectric strength, reducing the breakdown voltage, but this can usually be overcome by increasing the insulator thickness while still achieving a higher capacitance ratio. For any insulator, a tradeoff between breakdown voltage and capacitance ratio is involved in choosing insulator thickness. Once the capacitance ratio $C_H/C_L$ is determined, $C_H$ and $C_L$ are controlled by the area of the upper electrode.

Figure 4:
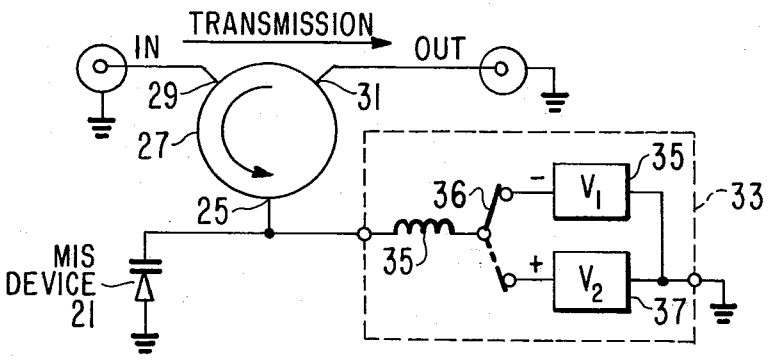
FIG. 4 is a phase shifter circuit using a metal-insulator-semiconductor device and a circulator.

Referring to FIG. 4, a reflection type phase shifter is illustrated using a circulator to convert a reflection phase shift to a transmission phase shift. There is no requirement in this form of phase shifter that the device impedance be zero or infinite in either state (except for the 180° phase shift case), so this approach is quite suited to the finite capacitance ratio of the MIS device. A MIS device 21 is mounted between ground and the second port 25 of a circulator 27. The first port 29 is the input port of the circulator 27, and the third port 31 of this circulator 27 is the output port. A switchable bias source 33 is coupled across the MIS device 21. Some means such as coil 35 is provided for choking the RF from the bias source 33. The switchable bias source 33 provides two selectable D.C. (direct current) bias voltages $V_1$ and $V_2$ via switch 36. The bias voltage from source 35 is $V_1$ in FIG. 3. The bias voltage from source 37 is $V_2$ in FIG. 3. Voltage $V_1$ reverse biases the device 21 and voltage $V_2$ forward biases device 21. The maximum RF voltage swing allowed across the devices is determined by the knees of the voltage-capacitance curve and the breakdown voltage ($V_{BR}$) of the device. If the nonlinear portion of the C-V curve is entered, the average capacitance will change in such a direction as to decrease the phase shift. Furthermore, the nonlinearity will generate harmonics. The breakdown voltage is usually higher in the reverse bias state. By making the bias point half way between these limits, the allowed swing is maximized. A reactance $X_L$ is associated with the first bias voltage of $V_1$ and a second reactance $X_H$ is associated with the second bias voltage of $V_2$. When the switch 36 is moved from source 35 to source 37, the MIS device switches from reactance $X_L$ to reactance $X_H$ and the reflection coefficient phase angle shifts from $\theta_1$ to $\theta_2$ for a phase shift of $\theta_2 - \theta_1$, where $\theta_1$ is the phase shift at first voltage $V_1$ and $\theta_2$ is the phase shift at second voltage $V_2$. Since the second port 25 of circulator 27 is terminated in a capacitance coupled to ground, the transmission coefficient between the first port 29 and the third port 31 is equal to the reflection coefficient of the terminating device 21 plus a fixed phase shift due to the path length in the circulator. Hence, a transmission phase shift of $\theta_2$ minus $\theta_1$ is produced.

Figure 5:
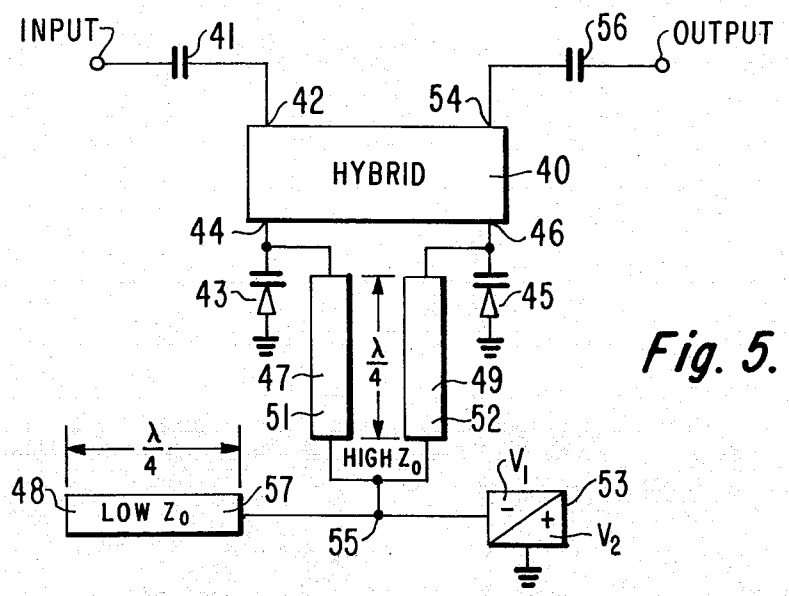
FIG. 5 is a phase shifter using a metal-insulator-semiconductor device and a quadrature hybrid.

Referring to FIG. 5, a reflection type phase shifter circuit using two MIS devices and a quadrature hybrid is illustrated. The input signal is applied via capacitor 41 and port 42 and the output signal is taken via port 54 and capacitor 56. The power applied to the hybrid 40 at port 42 is split exactly in half with half the power coupled to MIS device 43 at port 44 and half the power phase shifted an extra 90° and coupled to MIS device 45 at port 46. Each port of the hybrid 40 is then thought of as a generator of impedance $R_o$ and voltage $\sqrt{2 P_{in} R_o}$, where $R_o$ is the characteristic impedance of the system and $P_{in}$ is the power of the signal applied to the hybrid at input port 42. The switchable D.C. (direct current) bias from source 53 is supplied to MIS device 43 through high impedance quarter wave choke 47 and to MIS device 45 through high impedance quarter-wave choke 49. The quarter wave chokes 47 and 49 are terminated at the source end by a low impedance open circuited quarter wave stub 48. The switchable bias source 53 is like bias source 33 in FIG. 4. The bias must be supplied to both devices 43 and 45 since they are D.C. isolated by the hybrid 40. The quarter wave stubs 47 and 49 may be made of microstrip transmission line with the choke 47 comprising a quarter wavelength long strip-like conductor 41 spaced from a ground plane conductor (not shown) by a dielectric substrate (not shown). The conductor 51 is a quarter wavelength long at an input signal frequency. Similarly, choke 49 is made up of a quarter wavelength long strip-like conductor 52 spaced from a ground plane conductor (not shown) by a dielectric substrate (not shown). The low impedance stub 48 may be a quarter wavelength long microstrip section coupled to strips 51 and 52 at point 55. The stub 48 may be provided by a quarter wavelength long narrow strip-like conductor 57 spaced from a broad ground plane conductor (not shown) by a dielectric substrate (not shown).

When the devices 43 and 45 switch from reactance $X_L$ to reactance $X_H$ by switching the bias supplied by source 53, the reflection coefficient shifts from $\theta_1$ to $\theta_2$ in each of these devices and the phase of the output signal from the two devices is shifted $\theta_2$ minus $\theta_1$. The optimum capacitance value of $C_H$ to achieve reactance $X_H$ and $C_L$ to achieve reactance $X_L$ for lower order phase shifts (22.5°, 45°) can be determined as follows. The reflection coefficient for a capacitor terminating a transmission line is $$\Gamma = \frac{\frac{1}{j\omega c} - Z_o}{\frac{1}{j\omega c} + Z_o} \tag{8}$$

The phase $\theta$ of the reflection coefficient may be expressed as $$\theta + 2\tan^{-1}(-\omega c Z_o) \tag{9}$$

If the capacitor is switched between two different values ($C_1$, $C_2$), the net differential phase shift is $$\Delta\theta = \theta_2 - \theta_1 = 2\,[\tan^{-1}(-\omega c_2 Z_o) - \tan^{-1}(\omega c_1 Z_o)] \tag{10}$$

The values $C_1$, $C_2$ which yield a differential phase shift $\Delta\theta$ such that the phase shift slope is zero at $\omega = \omega_o$ are:

$$c_1 = \frac{1}{\omega_o Z_o}\left\{\sec\frac{\Delta\theta}{2} - \tan\frac{\Delta\theta}{2}\right\} \tag{11}$$

$$c_2 = \frac{1}{\omega_o Z_o}\cdot\frac{1}{\sec\frac{\Delta\theta}{2} - \tan\frac{\Delta\theta}{2}} \tag{12}$$

and the optimum capacitance ratio is found by dividing the above equation 11 into equation 12.

$$\frac{c_2}{c_1} \quad \frac{1}{\left[\sec\frac{\Delta\theta}{2} - \tan\frac{\Delta\theta}{2}\right]^2} \tag{13}$$

Table 1 that follows summarizes the capacitance ratios and values at a design center frequency of 3.5 GHz in a 50-ohm system.

Table 1.

SUMMARY OF CAPACITANCE RATIOS AND VALUES

| Δ * Θ | $c_2/c_1$ | $c_1$ (picofarads) | $c_2$ (picofarads) |
|---|---|---|---|
| 22.5° | 1.48 | .746 | 1.11 |
| 45.0° | 2.24 | .608 | 1.36 |
| 90.0° | 5.85 | .376 | 2.20 |
| 180.0° | ∞ | 0 | ∞ |

It should be noted that the values of capacitance obtained have a graphical significance on a reflection chart. The optimum reactance values ($X_L$, $X_H$), for a given phase shift $\Delta\theta$, fall symmetrically about the −90 degree phase coordinate. For two small capacitance values near the open circuit point, the reactance curves tend to bunch together yielding a small phase shift. For two large capacitance values with reactances near the short circuit point, the differential phase shift is small this time because the change in reactance is small. The optimum, therefore, lies halfway between the open circuit and short circuit points. The capacitance ratio is increased by decreasing the oxide (insulator) thickness or by increasing the depletion depth $X_{dm}$. The amount of capacitance is altered by changing the size of the surface area of layer 11.

Figure 6:
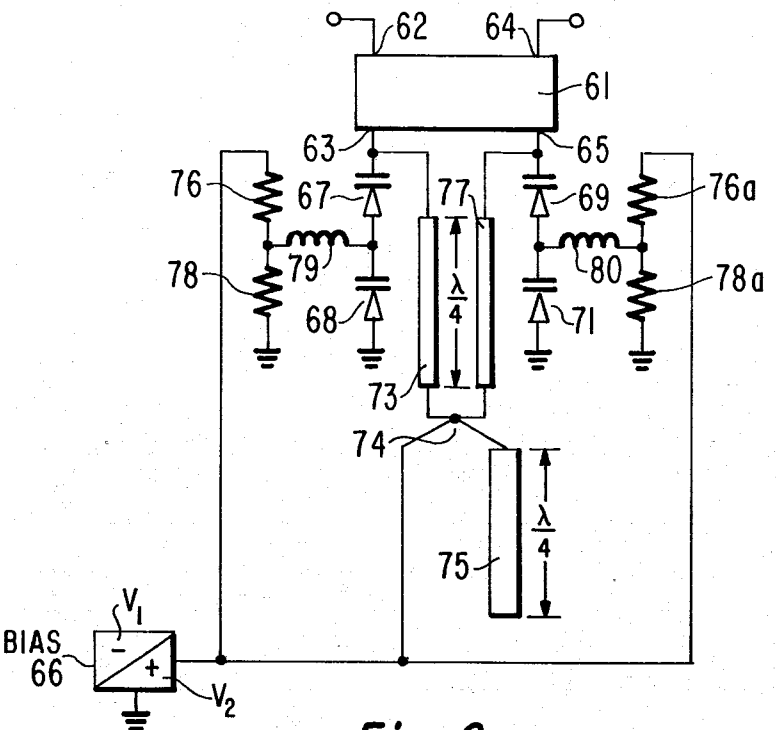
FIG. 6 is a phase shifter using series connected metal-insulator-semiconductor devices and a quadrature hybrid.

Decreasing the oxide thickness to obtain the 5.85 ratio to thereby achieve a 90° phase shift may cause voltage breakdown. This is overcome by connecting the devices in series as shown in FIG. 6. Referring to FIG. 6, the phase shifter includes a hybrid 61 with input signals coupled to first port 62 and the phase shifted output signals coupled from the fourth port 64. The input signals are equally divided with one half coupled to port 63 and the other half coupled to port 65. At port 63 are connected two MIS devices 67 and 68 in series to ground. At port 65 are connected MIS devices 69 and 71 in series to ground. D.C. bias from switchable source 66 to MIS device 67 is provided via high impedance one quarter wavelength choke 73. D.C. bias from switchable source 66 to MIS device 69 is provided via high impedance one quarter wavelength choke 77. The switchable source 66 is like source 33 in FIG. 4. The chokes 73 and 77 are constructed like chokes 47 and 49 in FIG. 5 and terminate at end 74 to quarter wave stub 75. The stub 75 is like the low impedance stub 48 in FIG. 5. D.C. bias from switchable source 66 to device 68 is provided via a voltage divider made up of resistors 76 and 78 and choke coil 79. D.C. bias from switchable source 66 to device 71 is provided via a voltage divider made up of resistors **76*a* and 78*a* and choke coil 80**. The same high capacitance ratio is required to achieve the 90° phase shift but because of the series connection of the two MIS devices, the breakdown voltage is increased. If two packaged MIS devices are connected to each other, the bonding wires produce an added inductance in series with the devices. The added series inductance causes a further increase in phase shift at the sacrifice of a lower bandwidth.

The change in reflection phase angle of a device which switches between two capacitance values, $C_1$ and $C_2$, is given in equation 10 as:

$$\Delta\theta = \theta_2 - \theta_1 = 2[\tan^{-1}(-\omega c_2 Z_o) - \tan^{-1}(-\omega c_1 Z_o)]$$

where $Z_o$ is the system characteristic impedance and $\omega$ is the angular frequency. It is seen that in order for $\Delta\theta$ to be 180°, the argument of the arctangent must be infinite, which is impossible for infinite capacitance values. Therefore, additional circuitry must be added external to the device to increase the phase shift.

Figure 7:
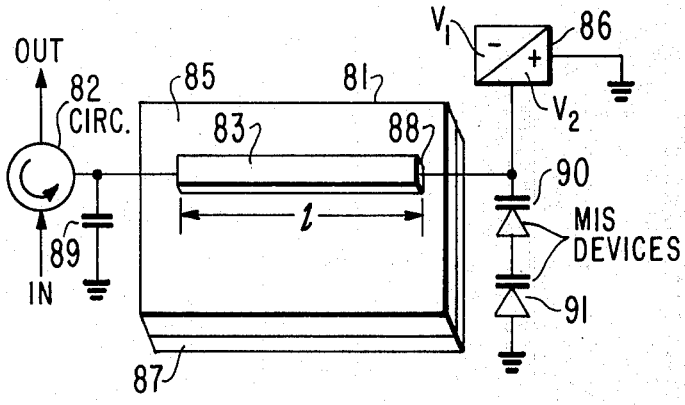
FIG. 7 is a simple phase shifter arrangement for achieving 180° phase shift.
Figure 8:
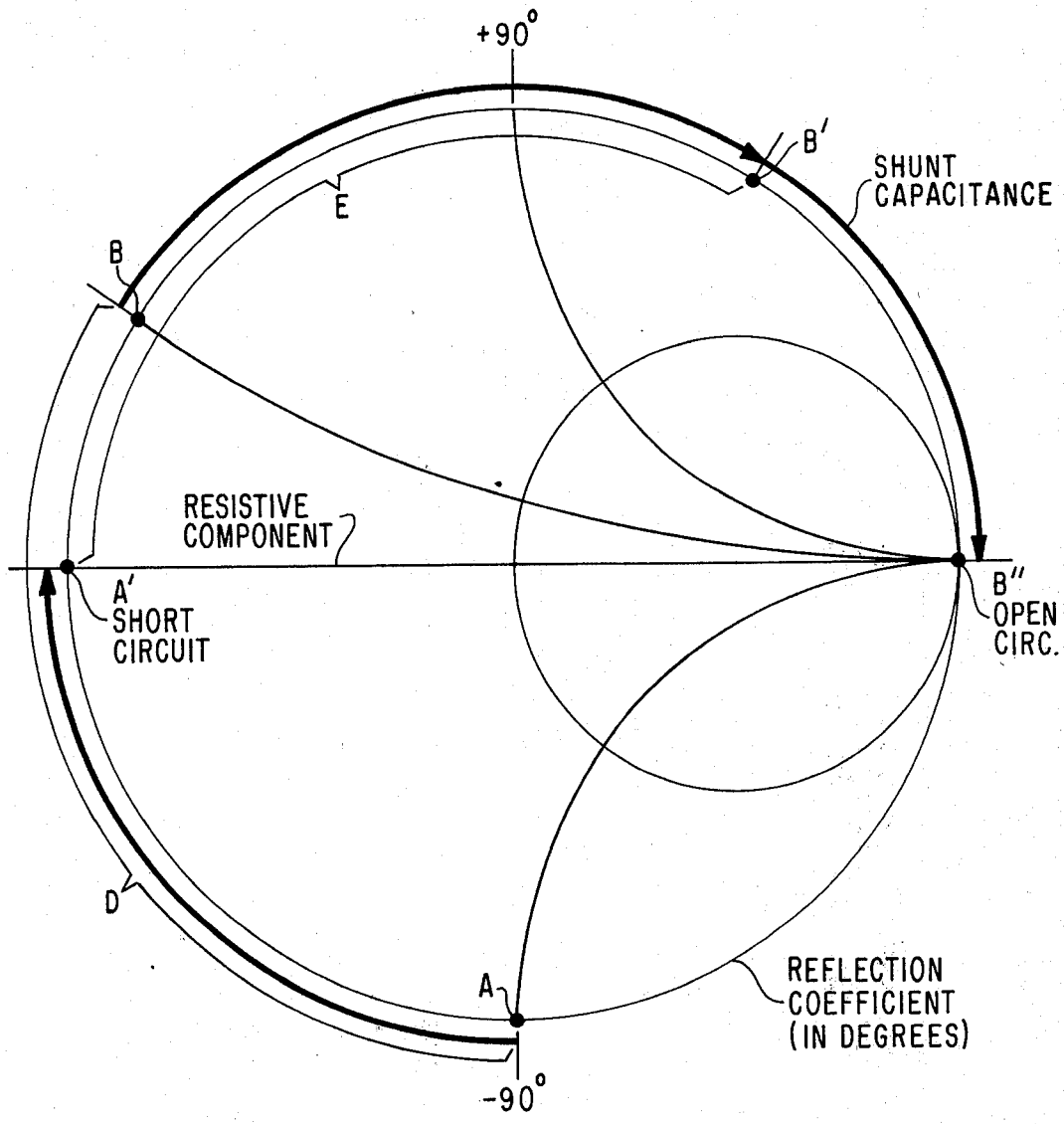
FIG. 8 is a sketch of a portion of a Smith Chart used to explain the operation of the phase shifter of FIG. 7.

Referring to FIG. 7, there is illustrated one preferred arrangement for achieving 180° phase shift when the MIS devices are packaged and hence have more leading inductance. The arrangement includes a circulator 82, a microstrip transmission line 81, a pair of MIS devices 90 and 91, and shunt capacitance 89. The line 81 comprises a narrow strip-like conductor 83 on one surface of a dielectric substrate 85. On the opposite surface of the substrate is a ground plane conductor 87. The circulator 82 couples the microwave signals to and from line 81. A series connection of two packaged MIS devices 90 and 91 is coupled to the opposite end 88 of the conductor 83. The series connection of the two packaged devices 90 and 91 switches between the reactance at point A to point B or for example spanned by bracket D in the Smith Chart of FIG. 8. These two points are 123 degrees apart. This switching of reactance values is achieved by switching the D.C. bias from $V_1$ to $V_2$ at source 86. This source 86 is like that of source 33 in FIG. 4. The section of transmission line 81 is of 50 ohm characteristic impedance line and the length is 0.128 wavelengths long. This section of line shifts these points A and B on the Smith Chart clockwise to points $A^1$ and $B_1$ or spanned by bracket E in FIG. 8 while preserving the phase difference. By adding the shunt capacitance 89 of 0.5 pF (picofarad) for this example the right most point $B^1$ is extended to point $B^{11}$ which is the 0° or open circuit point. The left most point at the short circuit point on the chart is unaffected by the shunt capacitance.

The transmission line characteristic impedance for an arrangement as described above in connection with FIG. 7 is equal to the system characteristic impedance. The length l of the transmission line section and the capacitance of the shunt capacitor 89 can be calculated as below from the values of $X_L$ and $X_H$, measured at a particular frequency.

The input impedance of a lossless transmission line of length l and characteristic impedance $Z_o$, when terminated in a load impedance $Z_1$ is given by the wellknown equation:

$$Z_{IN} = Z_o \left\{ \frac{Z_L + jZ_o \tan \beta l}{Z_o + jZ_L \tan \beta l} \right\} \tag{14}$$

If a short circuit is desired when $Z_L = jX_H$ $$Z_o \left\{ \frac{jX_L + jZ_c \tan \beta l}{Z_o + j(jX_L) \tan \beta l} \right\} = 0$$

$$jX_L + jZ_o \tan \beta l = 0$$

$$\tan \beta l = \frac{-X_L}{Z_o}$$

$$l = \frac{1}{\beta} \tan^{-1} \left( \frac{-X_L}{Z_o} \right) \tag{15}$$

A line of length l as calculated in equation 15 will transform reactance $X_H$ to a short circuit and will transform $X_L$ to:

$$X_L = Z_o \left\{ \frac{jX_H + jZ_o \left( \frac{-X_L}{Z_o} \right)}{Z_o + j(jX_L) \left( \frac{-X_L}{Z_o} \right)} \right\}$$

$$= Z_o \left\{ \frac{j(X_H - X_L)}{Z_o + \frac{X_L X_H}{Z_o}} \right\} \tag{16}$$

If a shunt element $C_S$ Whose reactance is $X_H'$ is now added, the total reactance in state 2 ($Z_L = X_H$) is:

$$\frac{jX_H(jX_H')}{jX_H + (jX_H')} = \infty \tag{17}$$

And in state 2 the reactance is:

$$\frac{0\ (-jX_H')}{0 + (jX_H')} = 0 \tag{18}$$

So the overall network switches between a short circuit (reflection phase angle = 180°) and an open circuit (reflection phase angle = 0°) so the differential phase shift $\Delta\theta = 180°$.

Figure 9:
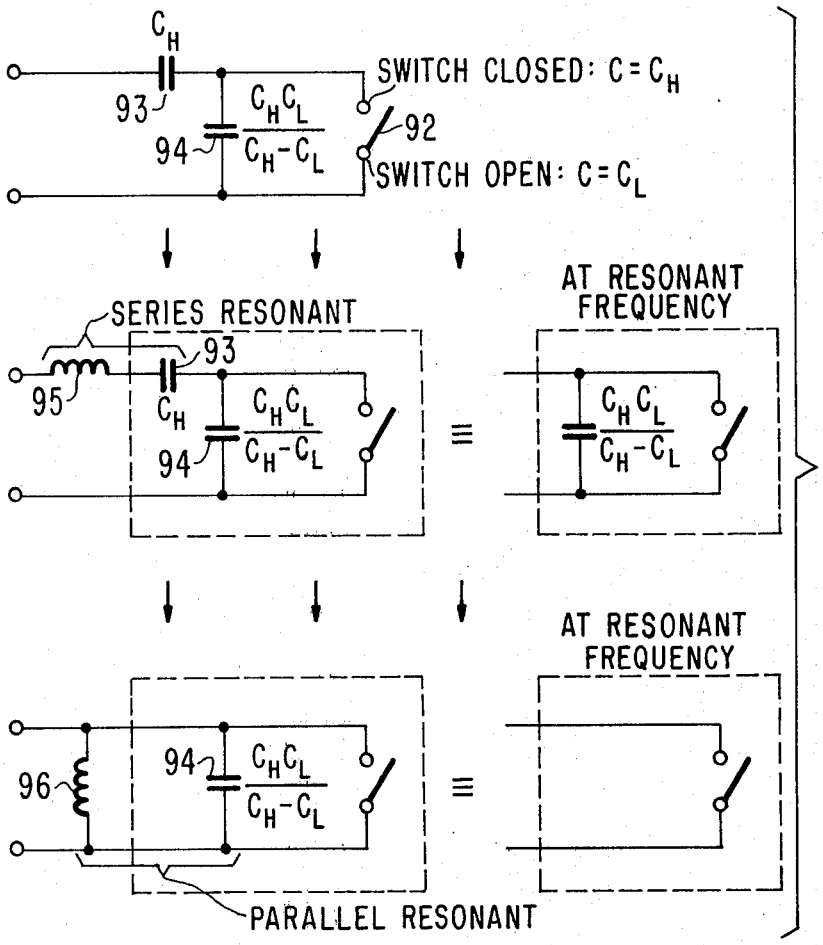
FIG. 9 illustrates a method of approximating an ideal switch where lead inductances are insignificant.
Figure 10:
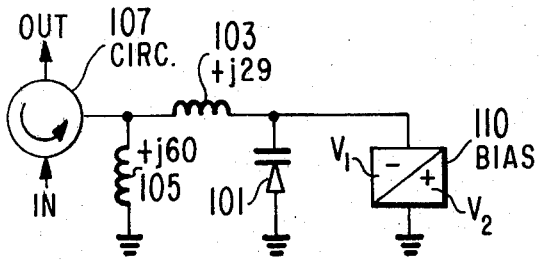
FIG. 10 is a 180° phase shifter according to another embodiment of the present invention.
Figure 11:
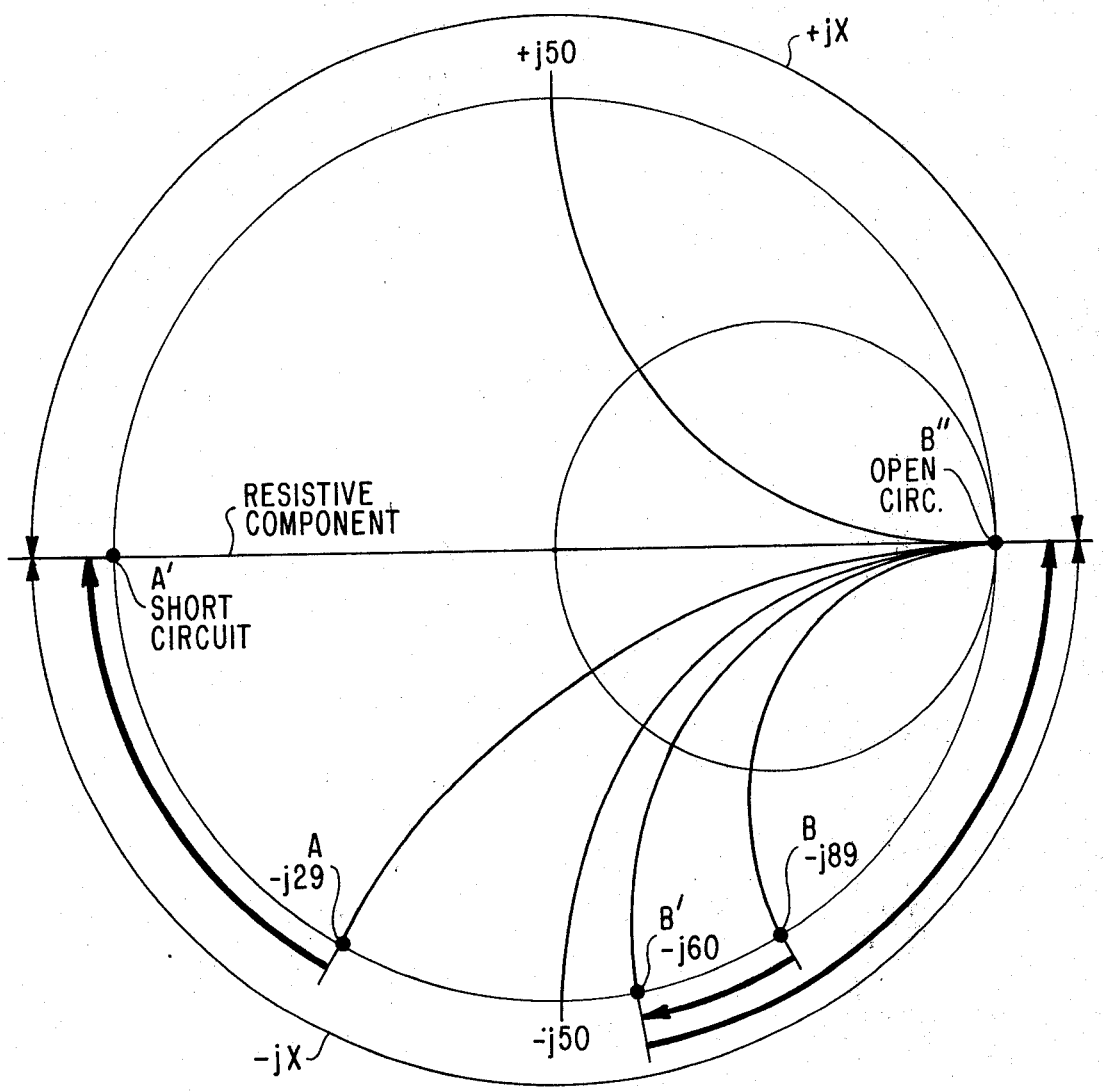
FIG. 11 is a sketch of a portion of a Smith Chart used to explain the operation of the phase shifter of FIG. 10.

Another approach for achieving 180° phase shift where lead inductances are insignificant as in unpackaged devices is achieved by the method illustrated in FIG. 9. Referring to top of FIG. 9, an ideal two state capacitor can be thought of as an ideal switch 92 imbedded in a network of two capacitors 93 and 94 of the values of $C_H$ and $$\frac{C_H C_L}{C_H - C_L}$$

respectively so that the equivalent capacitance between an open and closed switch would vary between $C_H$ and $C_L$ when switched. Resonating out these capacitors 93 and 94 at a given frequency leaves an ideal switch at that frequency. An inductor 95 of a value to be series resonant at the system operating frequency with capacitor 93 is added in series with capacitor 93, and an inductor 96 of a value to be parallel resonant with capacitor 94 at the system operating frequency is added in parallel with capacitor 94. This leaves a pure switch at the system operating frequency as shown at the bottom of FIG. 9. By proper choice of the capacitor values at $C_H$ and $C_L$ and the inductance values of the two added inductors 95 and 96, the bandwidth over which ideal switch performance is approximated can be optimized. For broad bandwidth, the capacitance ratio should be made as high as possible. Referring to the arrangement shown in FIG. 10, a 180° MIS device phase shifter is illustrated using an unpackaged MIS device or an MIS device with no package strays. The MIS device 101 illustrated in FIG. 10 is selected for example to have reactances at voltages $V_1$ and $V_2$ from bias source 110 that fall initially at points A and B in the Smith Chart of FIG. 11. This gives a phase shift of 60°. If a series inductor 103 whose reactance is $+j$ 29 is added as illustrated in FIG. 10, the one reactance at point A is shifted to point $A^1$ in FIG. 11, the short circuit point, while the other reactance at point B in FIG. 11 is shifted to point $B^1$ in FIG. 11. The phase shift is then 100°. A shunt inductor 105 of $+j$ 60 is added as illustrated in FIG. 11, which is sufficient to shift the other reactance at point $B^1$ to $B^{11}$. The one reactance at point $A^1$ will not move with the addition of a shunt element since anything in shunt with a short is still a short. Hence, the overall reactance is a short circuit in one state and an open circuit in the other state and the phase difference is 180°. These inductances can be formed at microwave frequencies by short sections of narrow strip-like conductors on the dielectric substrate. Input coupling of microwave signals into and from device 101 is provided by circulator 107. The bias source 110 may be like source 33 in FIG. 4.

What is claimed is:

1. A phase shifter for microwave signals of high power level comprising:

a metal-insulator-semiconductor device of uniform cross-section with the insulator layer spaced continuously between said metal and said semiconductor layer and having a pair of terminals and characterized by exhibiting a first substantially fixed value of capacitance when biased over a first relatively broad range of D.C. bias voltages in a first direction and by exhibiting a second substantially fixed value of capacitance when biased over a second relatively broad range of D.C. bias voltages in a second reverse direction;

first coupling means coupling the first terminal of said pair to a point of reference, reflecting potential;

second coupling means for coupling said microwave signals to the second terminal of said device and for coupling the signals reflected from said device at said second terminal to an output means; and means for biasing said device initially by a D.C. voltage within said first range in said first direction and then by a D.C. voltage within said second range in said second reverse direction, whereby the reflection coefficient phase angle shifts substantially a given amount providing a substantially given amount of phase shift of said microwave signals.

2. The combination claimed in claim 1 wherein said second coupling means includes a circulator.

3. The combination claimed in claim 1 wherein said second coupling means includes a hybrid.

4. The combination claimed in claim 1 including a second metal-insulator-semiconductor device in series with said first mentioned device.

5. A phase shifter for providing a phase shift of 180° to microwave signals of high power level comprising:

a metal-insulator-semiconductor device of uniform cross-section with an insulator layer spaced continuously between said metal and said semiconductor layer and having a pair of terminals and characterized by exhibiting a first relatively fixed value of capacitance when biased at a first bias voltage within a first relatively broad range of D.C. bias voltages in a first direction and by exhibiting a second different value of capacitance when biased at a second reverse bias voltage within a second relatively broad range of D.C. bias voltages in a second reverse direction;

first coupling means for coupling the first terminal of said pair to a point of reference, reflecting potential;

second coupling means for coupling microwave signals to the second terminal of said device and for coupling the signals reflected from said devices to an output means, said second coupling means including a short section of microstrip transmission line of a given length connected in series with said device for, with said device, reflecting a short circuit to said output means when said device is at said first value of capacitance and means coupled in parallel with said device for, with said device, reflecting an open circuit to said output means when said device is at said second value of capacitance, and means adapted to selectively apply said first and second bias voltages to said device.

6. The combination claimed in claim 5 wherein said means coupled in parallel with said metal-insulator-semiconductor device includes an inductor.

7. The combination claimed in claim 5 including a second metal-insulator-semiconductor device in series with said first mentioned device and wherein said devices are inductively packaged and said means coupled in parallel includes a capacitance.

* * * * *